US005955937A

United States Patent [19]

Groen

[11] Patent Number: 5,955,937

[45] Date of Patent: Sep. 21, 1999

[54] RARE EARTH METAL-CONTAINING HIGH-TEMPERATURE THERMISTOR

[75] Inventor: Wilhelm-Albert Groen, Limbricht, Netherlands

[73] Assignee: U.S. Philips Corporation, New York, N.Y.

[21] Appl. No.: 08/863,990

[22] Filed: May 28, 1997

[30] Foreign Application Priority Data

May 31, 1996 [DE] Germany ..... 196 21 934

[51] Int. Cl.[6] ..... H01C 7/10

[52] U.S. Cl. ..... 338/22 SD; 338/22 R

[58] Field of Search ..... 338/22 SD, 22 R; 252/519.15, 521.1

[56] References Cited

U.S. PATENT DOCUMENTS

| | | | |
|---|---|---|---|
| 4,097,345 | 6/1978 | Shannon | 204/59 |
| 4,126,583 | 11/1978 | Walter | 252/521 |
| 5,252,544 | 10/1993 | Maeda et al. | 505/1 |
| 5,292,716 | 3/1994 | Sakai et al. | 505/1 |
| 5,644,284 | 7/1997 | Moriwake et al. | 338/22 R |

OTHER PUBLICATIONS

"Electroceramics", A.J. Moulson et al, Chapman and Hall, London, pp. 140–141, 1990.

*Primary Examiner*—Michael L. Gellner
*Assistant Examiner*—Richard Kyung Lee
*Attorney, Agent, or Firm*—F. Brice Faller

[57] ABSTRACT

A thermistor comprising a semiconductor ceramic of a mixed crystal oxide composed of rare-earth metals having the composition $$[Y_aGd_bSm_cTb_d]_2O_3,$$

wherein
$0 \leqq a \leqq 0.995$
$0 \leqq b \leqq 0.995$
$0 \leqq c \leqq 0.995$
$0.01 \leqq d \leqq 0.995$, and
a=0 if b=0, or
b=0 if a=0,
has a high-temperature stability and can be used at temperatures up to 1100° C.

10 Claims, 3 Drawing Sheets

RARE EARTH METAL-CONTAINING HIGH-TEMPERATURE THERMISTOR

The invention relates to a high-temperature thermistor comprising a semiconductor ceramic which is composed of a mixed-crystal oxide of the rare-earth metal oxides, in particular a thermistor which can be used in the entire temperature range from room temperature to 1100° C.

As a result of new applications in the field of immission control, high-temperature thermistors have become more important in the last few years. They are used, for example, as temperature sensors for measuring the temperature of industrial exhaust gases or as temperature-control means and maximum-temperature guards for the catalytic exhaust-gas burning in motorcars. The temperatures at which they are used in motorcars typically range between 600° C. and 1100° C. as an optimal catalytic exhaust-gas burning can only take place at such elevated temperatures. In this temperature range, thermistors made of oxidic semiconductor ceramic have the advantage, as compared to thermoelements, that they have a much greater output signal, so that a simpler circuit technology suffices for signal processing.

Thermistors are also referred to as NTC resistors because their resistance exhibits a negative temperature coefficient (NTC). The resistivity of NTC resistors decreases approximately exponentially as the temperature increases, in accordance with the equation $\rho=\rho_0 \exp B(1/T-1/T_0)$, wherein $\rho$ and $\rho_0$ are the resistivities at the absolute temperatures T and $T_0$, respectively, B is a thermal constant and T is the temperature expressed in Kelvins. For a thermistor it is very favorable if the resistance/temperature characteristic is as steep as possible. This steepness is determined by the constant B.

In known technical solutions for thermistors use is made of oxidic semiconductor ceramics based on spinel-type or perovskite-type oxidic compounds of the transition metals. Use is often made of multi-phase systems in which the starting material is modified by further components. Current NTC components are made almost exclusively of spinel-structured mixed crystals composed of 2 to 4 cations selected from the group formed by Mn, Ni, Co, Fe, Cu and Ti. For such multi-phase systems, the nominal resistance $R_{25}$ and the B constant, which determines the temperature-sensitivity, are set at variable values by an appropriate reaction-process control during the manufacture, so that in the case of a certain batch, a specific assortment of thermistors can be produced. In general, this method involves a broad spread between the data of the individual pieces and between the different batches, because, dependent upon the eventually structure and texture of the ceramic material, the electrical parameters characterizing the thermistor assume slightly different values. Therefore, an assortment of thermistors exhibiting long-time stability and having sufficiently narrow tolerances requires different thermal and electrical aftertreatments as well as two further individual process steps in which the thermistors are classified and separated.

The fabrication spread of NTC thermistors is very critical because the contaminant content in the sintering material is difficult to control. In addition, ceramic compounds formed during the manufacture of said thermistors, and the crystal structures of said compounds, may change with time, in particular at elevated temperatures. Moreover, at elevated temperatures a slow reaction with atmospheric oxygen may take place, which leads to a permanent change of the resistance value and of the temperature characteristic.

Consequently, spinel or perovskite-type mixed-crystal oxides can only be used up to approximately 500° C. At higher temperatures their long-term stability is insufficient and, for a number of fields of application, their resistivity too small.

A. J. Moulson and J. M. Herbert, "Electroceramics", Chapman and Hall, London, p. 141 (1990) disclose the use of mixtures of rare earth metal oxides, i.e. a mixture comprising 70 at. % Sm and 30 at. % Th, for thermistors which are to be used at very high temperatures. This mixture can be used up to 1000° C. because the tendency to react with atmospheric oxygen is absent.

At very high temperatures above 1000° C., however, also this high-temperature thermistor material exhibits instabilities in the resistance value.

Therefore, it is an object of the invention to provide a high-temperature thermistor which exhibits narrow tolerances and a long-term stability also at very temperatures.

In accordance with the invention, this object is achieved by means of a thermistor comprising a semiconductor ceramic of a mixed-crystal oxide composed of rare-earth metals having the composition $[Y_aGd_bSm_cTb_d]_2O_3$, wherein $0 \leqq a \leqq 0,995$; $0 \leqq b \leqq 0.995$; $0 \leqq c \leqq 0.995$; $0.1d \leqq 0.995$ and a>0 if b=0, or b>0 if a=0. Such a thermistor can be used as a temperature sensor for temperatures up to 1100° C. Said thermistor is characterized by a very high stability at very high operating temperatures above 1000° C. Consequently, it can very suitably be used as a sensor in the high-temperature range in which catalytic exhaust-gas cleaning takes place or as a temperature-regulating device for the motor control.

Within the scope of the invention, it is particularly preferred that the mixed crystal oxide has a cubic crystal structure of the C—$M_2O_3$-type. Thermistors comprising a semiconductor ceramic of such mixed crystal oxides are characterized by i very high temperature stability.

It may alternatively be preferred that the mixed crystal oxide is further doped with an element of the group formed by neodymium, europium, gadolinium, dysprosium, holmium, erbium, thulium, ytterbium and lutetium.

Preferably, $0.5 \leqq a \leqq 0.99$; b=0, c=0 and $0,01 \leqq d \leqq 0.5$. It is also preferred that $0.65 \leqq a \leqq 0.75$, b=0, c=0, $0.25 \leqq d \leqq 0.35$. It is particularly preferred that a=0 and $0.1 \leqq b \leqq 0.7$, c=0 and $0.3 \leqq d \leqq 0.9$. It is also preferred that $0 \leqq a \leqq 0.30$, b=0 and $0.2 \leqq c \leqq 0.5$ and $0.2 \leqq d \leqq 0.6$.

The invention further relates to a semiconductor ceramic of a mixed crystal oxide having the composition $[Y_aGd_bSm_cTb_d]_2O_3$ wherein $0 \leqq a \leqq 0.995$; $0 \leqq b \leqq 0,995$; $0 \leqq c \leqq 0.995$; $0.01 \leqq d \leqq 0.995$ and a>0 if b=0, or b>0 if a=0. Particular preference is given to a semiconductor ceramic, which is characterized in that the mixed crystal oxide has a cubic crystal structure of the C—$M_2O_3$-type.

These and other aspects of the invention will be apparent from and elucidated with reference to the embodiments described hereinafter.

In the drawings:

FIG. 1 is the Arrhenius curve for semiconductor ceramic of yttrium-terbium-oxide mixed crystals, FIG. 2 shows the Arrhenius curve for semiconductor ceramic of yttrium-samarium-terbium-oxide mixed crystals, FIG. 3 shows the Arrhenius curve for semiconductor ceramic of gadolinium-terbium-oxide mixed crystals in comparison with the Arrhenius curves shown in FIGS. 1 and 2.

The semiconductor ceramic comprising a mixed crystal oxide of the rare earth metals in accordance with the invention contains binary, ternary, quaternary etc. mixed crystal oxides, i.e. multiple mixed crystal oxides whose essential constituent is terbium, and at least a further rare earth metal oxide of the group formed by yttrium, samarium, gadolinium. The mixed crystal oxide may further be doped with neodymium, europium, dysprosium, holmium, erbium, thulium, ytterbium or lutetium.

By virtue of the terbium content in the structure, the semiconductor ceramic contains mobile electrons, which are the most important contributors to the conductivity of the semiconductor ceramic.

The composition of the mixed crystal oxide is preferably selected so that a crystal structure of the cubic C—$M_2O_3$-type is obtained. This can only be achieved if the average ion radius of the cations, in accordance with the values indicated by R. D. Shannon, Acta Cryst. A32 (1976) 751, is below 1.06 Å. These semiconductor ceramics are monomorphous, i.e. their crystal structure does not change at elevated temperatures.

Mixed crystal oxides of the rare earth metals having a relatively large average ion radius, such as terbium sesquioxide, crystalize into the less symmetric A—$M_2O_3$-type or B—$M_2O_3$-type. They are polymorphous; at medium and high temperatures, their crystal structure converts to the C—$M_2O_3$-type (see A. F. Wells, Structural Inorganic Chemistry 4th edition, Clarendon Press, Oxford, p. 450 ff. (1975). Terbium sesquioxide itself converts to said cubic C—$M_2\mathbf{0}_3$ structure at approximately 1000° C. Surprisingly, it has been found that the mixed crystal oxides according to the invention, which crystallize into the C—$M_2O_3$-type, exhibit a highly improved stability at very high temperatures, which can be attributed to the fact that in said mixed crystal oxides comprising cations as defined above, the crystal structure does not change at elevated temperatures.

The semiconductor ceramic is manufactured in accordance with the customarily used methods. For the starting compounds use is made of binary oxides of the above-mentioned rare earth metals or, for example, of their oxalates, carbonates, hydroxides and such. The starting mixtures are weighed, whereafter they are mixed, either in the wet or in the dry state, and ground. Subsequently, to enhance the chemical homogenization and densification, preferably, a calcining process at 1000° C. is carried out. After a further grinding operation, the moulding process in which green bodies are formed is carried out by pressing, foil drawing, screen printing and such. The resultant green bodies are subjected to a binder burn-out process and subsequently sintered at temperatures in the range from 1250° C. to 1400° C. Said sintering process is substantially insusceptible to trouble and is governed neither by the gas atmosphere nor by the cooling curve.

The connecting electrodes, which are preferably made of platinum, can be baked-in as wire electrodes in the sintering process. It is alternatively possible, however, to provide platinum paste by means of screen printing, which is subsequently baked-in. Use can alternatively be made of other methods, such as vacuum evaporation techniques.

To test the thermistors, the resistance and the temperature-dependence in the temperature range from 200° C. to 1100° C. are determined. In addition, the thermal resistance of the thermistors at high temperatures was measured.

EXAMPLE 1

Mixed crystal oxides are prepared, which comprise $Y_2O_3$ and, respectively, 3, 10 and 30 at. % terbium. The starting compounds $Y_2O_3$ and $T_{b4}O_7$ are mixed in the proper ratio and ground for 16 hours by means of zirconium grinding balls. This premixed powder is granulated with a conventional binder preparation. Said granulate is pressed into pellets having a diameter of 6 mm and a thickness of 1 mm. These pellets are sintered in air for six hours at 1350° C. X-ray diffraction recordings show that the resultant semiconductor ceramic of mixed crystal oxides is a single-phase material having a C—$M_2O_3$ structure. The average ion radius of the mixed crystal oxides is 1.016 Å, 1018 Å and 1.023 Å, respectively. The relative density of the mixed crystal oxides is more than 94% of the theoretical density.

EXAMPLE 2

In accordance with the method described in example 1, quaternary mixed crystal oxides of yttrium oxide, samarium oxide and terbium oxide having the composition $Y_{0.5}SM_{0.9}Tb_{0.6}O_3$ and $Y_{0.5}Sm_{0.5}Tb_{1.0}O_3$ are manufactured. X-ray diffraction recordings show that the material is single-phase and that it crystallizes into the C—$M_2O_3$-type. The average ion radius of the mixed crystal oxides is 1.056 Å and 1.046 Å, respectively. The relative density is more than 95% of the theoretical density.

EXAMPLE 3

In accordance with the method described in example 1, a ternary mixed crystal oxide of the composition $Gd_{1.4}Tb_{0.6}O_3$ is manufactured. X-ray diffraction recordings show that the material is single-phase and that it crystallizes into the C—$M_2O_3$-type. The average ion radius of the mixed crystal oxides is 1.054 Å. The density is more than 95% of the theoretical density.

Test results

Temperature/resistance characteristics.

To test the thermistors in accordance with the invention, their temperature/resistance characteristics are measured.

To this end, pellets of the semiconductor ceramic in accordance with the invention are provided on either side with platinum paste to enable contact to be made. The resistivity is measured while the temperature is varied. The reciprocal temperature is plotted against the logarithm of the specific conductivity σ. In this manner, the Arrhenius curve is obtained, the slope of which is used to calculate the coefficient of thermal resistance B in accordance with the formula $B=(1nR_1-1nR_2)/(1/T_1-1/T_2)$. In the case of thermistors, there must be a linear correlation between the temperature and the electrical output magnitude. In the temperature range in which the Arrhenius curve is linear or substantially linear, the semiconductor ceramic can be used as a thermistor.

FIG. 1 shows the Arrhenius curves for three yttrium-terbium-mixed crystal oxides. Said three curves are substantially linear in the temperature range from approximately 200° C. to 1100° C. In this temperature range the semiconductor ceramics can be used as thermistors. Yttrium-terbium-mixed crystal oxides having a terbium content above 10 at. % have particularly favorable properties. They can be used up to 100° C.

Figure 1:
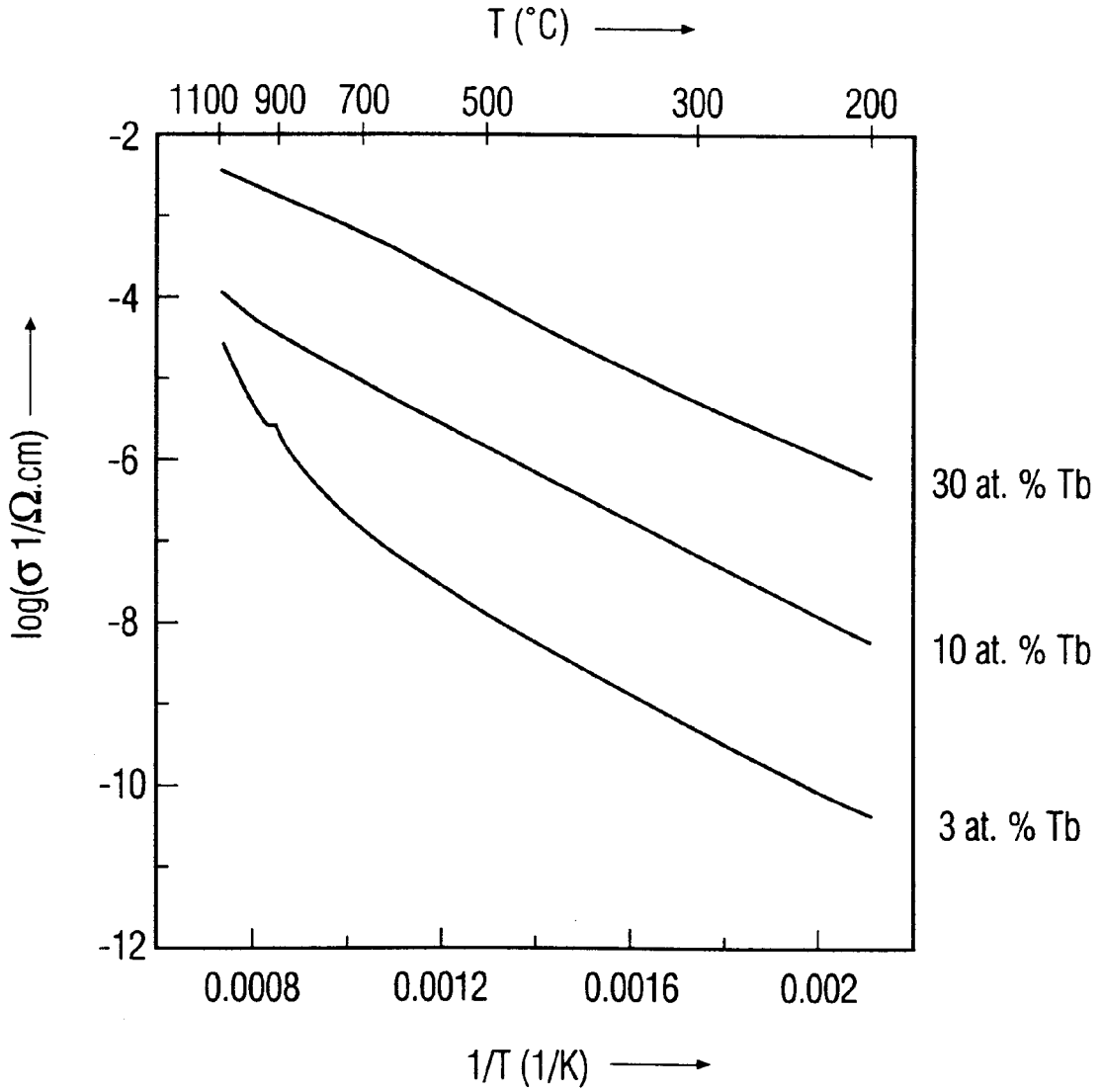
Figure 2:
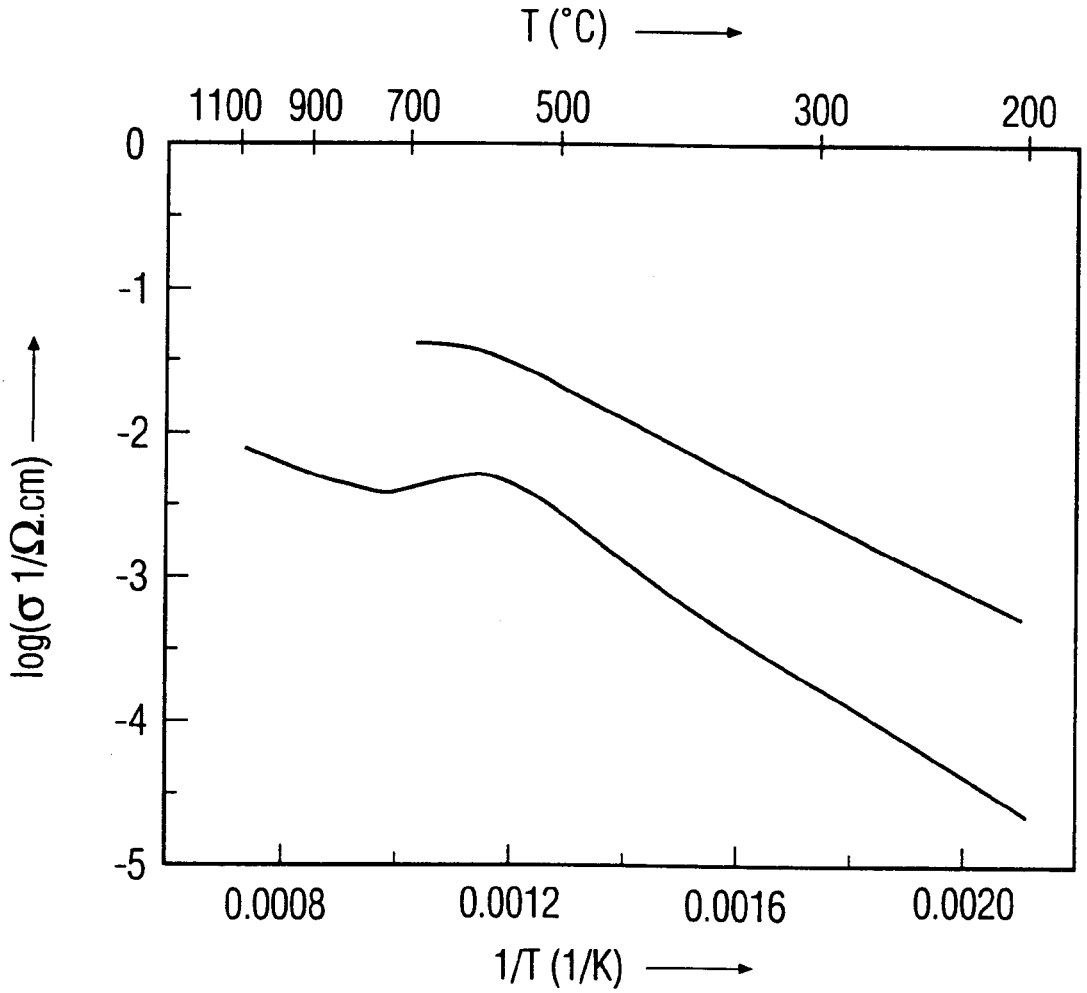
FIG. 2 shows the Arrhenius curve for $Y_{0.5}Sm_{0.9}Tb_{0.6}O_3$ (lower curve) and for $Y_{0.5}Sm_{0.5}Tb_{1.00}3$ (upper curve). By virtue of the lower resistance and the non-linearity of the Arrhenius curves at temperatures above 600° C., these mixed crystal oxides can be used as sensors at temperatures in the range from 20° C. to 600° C.
Figure 3:
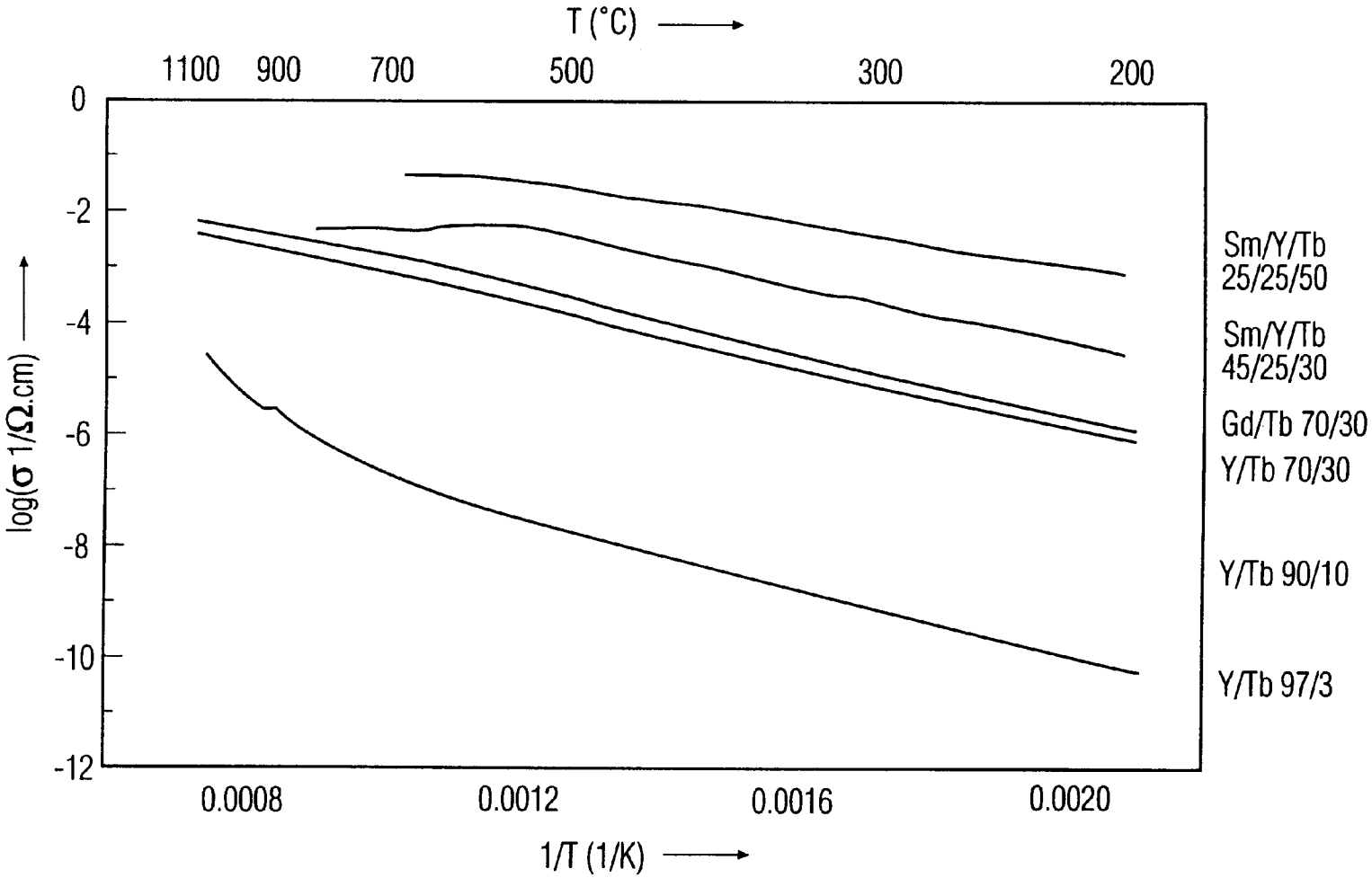
FIG. 3 shows, for comparison, the Arrhenius curves for $Gd_{1.4}Tb_{0.6}O_3$ and the Arrhenius curves of FIGS. 1 and 2. Also this material can be used at temperatures in the range from 200° C. to 1100° C.

Table 1 lists the specific conductivity values and the thermal-constant-B values of the mixed crystal oxides described in examples 1 to 3.

TABLE 1

Specific conductivities and B constants.

| Composition | log σ (300 ° C.) ($\Omega^{-1}.cm^{-1}$) | log σ (600 ° C.) ($\Omega^{-1}.cm^{-1}$) | log σ (900 ° C.) ($\Omega^{-1}.cm^{-1}$) | $B_{300/600}$ (K) | $B_{600/900}$ (K) |
|---|---|---|---|---|---|
| 97% $Y_2O_3$:3% Tb | −9.333 | −7.386 | — | 7472 | — |
| 90% $Y_2O_3$:10% Tb | −7.225 | −5.445 | −4.483 | 6831 | 7570 |
| 70% $Y_2O_3$:30% Tb | −5.310 | −3.553 | −2.487 | 6743 | 6252 |
| 70% $Gd_2O_3$:30% Tb | −5.082 | −3.215 | −2.487 | 7165 | 5729 |
| 45% $Sm_2O_3$:30% Tb:25 % Y | −3.771 | −2.262 | — | 5791 | — |
| 25% $Sm_2O_3$:50% Tb:25 % Y | −2.587 | −1.430 | — | 4440 | — |

Ageing

The temperature/resistance characteristic must also be accurately reproducible at high temperatures. In particular for applications in the automotive industry, the temperature deviations ΔT should not exceed +/−/2% in the range from 600° C. to 1000° C., i.e. at a temperature of 1000° C., the deviation should maximally be 20° C.

For these measurements use is always made of two identical thermistors. One thermistor is heated to 1000° C. for 100 hours. Subsequently, the resistance/temperature characteristics of both thermistors are measured. If the resistance is plotted as a function of temperature for both thermistors, two parallel curves are obtained which are shifted by Δt with respect to each other. The result of the measurements is shown in Table 4.5. These results show that mixed crystal oxides on the basis of yttrium oxide yield the best results. In the case of $Y_2O_3$ containing 30 at. % terbium oxide no ageing effects were observed.

TABLE 2

High-temperature reliability

| Composition | ΔT (° C.) |
|---|---|
| 70% $Sm_2O_3$:30% Tb | 13 |
| 65% $Sm_2O_3$:30% Tb:5% Nd | 10 |
| 90% $Y_2O_3$:10% Tb | 4 |
| 70% $Y_2O_3$:30% Tb | 0 |

I claim:

1. A thermistor comprising a semiconductor ceramic of a mixed crystal oxide composed of rare-earth metals having the composition $$[Y_aGd_bSm_cTb_d]_2O_3,$$

wherein $0 \leqq a \leqq 0.995$ $0 \leqq b \leqq 0.995$ $0 \leqq c \leqq 0.995$ $0.1 \leqq d \leqq 0.995$, and a>0if b=0, or b>0if a=0.

2. A thermistor as claimed in claim 1, characterized in that the mixed crystal oxide has a cubic crystal structure of the C—$M_2O_3$-type.

3. A thermistor as claimed in claim 2, characterized in that the mixed crystal oxide is further doped with an element of the group formed by neodymium, europium, gadolinium, dysprosium, holmium, erbium, thulium, ytterbium and lutetium.

4. A thermistor as claimed in claim 1, characterized in that $0.5 \leqq a \leqq 0.99$ b=0 c=0

$0.01 \leqq d \leqq 0.5$.

5. A thermistor as claimed in claim 1, characterized in that $0.65 \leqq a \leqq 0.75$ b=0 c=0

$0.25 \leqq d \leqq 0.35$.

6. A thermistor as claimed in claim 1, characterized in that a=0

$0.1 \leqq b \leqq 0.7$ c=0

$0.3 \leqq d \leqq 0.9$.

7. A thermistor as claimed in claim 1, characterized in that $0 \leqq a \leqq 0.30$ b=0

$0.2 \leqq c \leqq 0.5$ $0.2 \leqq d \leqq 0.6$.

8. A semiconductor ceramic of a mixed crystal oxide having the composition $$[Y_aGd_bSm_cTb_d]_2O_3,$$

wherein $0 \leqq a \leqq 0.995$ $0 \leqq b \leqq 0.995$ $0 \leqq c \leqq 0.995$ $0.01 \leqq d \leqq 0.995$, and a>0, if b=0 or b>0, if a=0.

9. A semiconductor ceramic as claimed in claim 8, characterized in that the mixed crystal oxide has a cubic crystal structure of the C—$M_2O_3$-type.

10. A semiconductor ceramic as claimed in claim 9, characterized in that the mixed crystal oxide is further doped with an element of the group formed by neodymium, europium, gadolinium, dysposium, holmium, erbium, thulium, ytterbium and lutetium.

* * * * *